US010232283B2

(12) United States Patent
Liao et al.

(10) Patent No.: US 10,232,283 B2
(45) Date of Patent: Mar. 19, 2019

(54) SMOKE GENERATOR

(71) Applicants: Ying-Chieh Liao, Taichung (TW); Yu-Kuo Liao, Taichung (TW)

(72) Inventors: Ying-Chieh Liao, Taichung (TW); Yu-Kuo Liao, Taichung (TW)

( * ) Notice: Subject to any disclaimer, the term of this patent is extended or adjusted under 35 U.S.C. 154(b) by 437 days.

(21) Appl. No.: 15/149,358

(22) Filed: May 9, 2016

(65) Prior Publication Data

US 2017/0319979 A1 Nov. 9, 2017

(51) Int. Cl.

| | |
|---|---|
| ***F24F 6/08*** | (2006.01) |
| ***A63J 5/02*** | (2006.01) |
| ***F23D 3/02*** | (2006.01) |
| ***F23D 99/00*** | (2010.01) |

(52) U.S. Cl.

CPC ..... *A63J 5/025* (2013.01); *F23D 3/02* (2013.01); *F23D 99/00* (2013.01)

(58) Field of Classification Search

None

See application file for complete search history.

(56) References Cited

U.S. PATENT DOCUMENTS 1,994,932 A * 3/1935 Lucien ..... A61L 2/204 392/405
2,850,615 A * 9/1958 Luse, Jr. ..... A63J 5/023 122/41
3,024,200 A * 3/1962 Smith ..... G01M 9/04 392/392
3,161,985 A * 12/1964 Fiske ..... A01M 13/00 111/125
3,178,850 A * 4/1965 Brown ..... A63H 33/28 40/407
3,234,357 A * 2/1966 Seuthe ..... A63H 33/28 261/142
3,238,642 A * 3/1966 Ohlund ..... F41A 33/04 273/372
3,242,098 A * 3/1966 Andrews ..... A01G 13/065 239/138
4,741,717 A * 5/1988 Wolf ..... A63H 33/28 446/24
4,764,660 A * 8/1988 Swiatosz ..... F41H 9/06 219/505
4,818,843 A * 4/1989 Swiatosz ..... A62B 27/00 392/397
4,836,452 A * 6/1989 Fox ..... A63J 5/025 239/14.1
4,871,115 A * 10/1989 Hessey ..... A63J 5/025 239/136
H000765 H * 4/1990 Yu ..... 60/264

(Continued)

FOREIGN PATENT DOCUMENTS

| | | |
|---|---|---|
| TW | M451175 | 4/2013 |
| TW | M492783 | 1/2015 |

*Primary Examiner* — Thor S Campbell

(74) *Attorney, Agent, or Firm* — Muncy, Geissler, Olds & Lowe, P.C.

(57) ABSTRACT

A smoke generator is provided, including a smoke generating unit and an airflow system. The airflow system has an air inlet passage, an air outlet passage and a vacuum generator, the vacuum generator communicates with the air inlet passage and the air outlet passage, and the vacuum generator has a suction portion communicating with the smoke generating unit.

9 Claims, 5 Drawing Sheets

(56) References Cited

U.S. PATENT DOCUMENTS

| | | | | |
|---|---|---|---|---|
| 5,320,536 | A * | 6/1994 | Rogers | A62C 99/0081 434/226 |
| 5,922,944 | A * | 7/1999 | Pieroni | G01M 3/20 239/136 |
| 6,189,453 | B1 * | 2/2001 | Lin | F22B 1/282 102/334 |
| 6,400,897 | B1 * | 6/2002 | Lin | A63J 5/025 222/321.9 |
| 7,305,176 | B1 * | 12/2007 | Pieroni | F24F 11/30 392/395 |
| 2004/0020998 | A1 * | 2/2004 | Stueble | A01G 9/246 239/14.1 |
| 2005/0262756 | A1 * | 12/2005 | Younger | A01K 55/00 43/128 |
| 2007/0223893 | A1 * | 9/2007 | Chen | F22B 1/282 392/398 |
| 2008/0230052 | A1 * | 9/2008 | Montaser | A61M 15/0085 128/200.16 |
| 2018/0136075 | A1 * | 5/2018 | Lerman | A63J 5/025 |

* cited by examiner

SMOKE GENERATOR

BACKGROUND OF THE INVENTION

Field of the Invention

The present invention relates to a smoke generator.

Description of the Prior Art

In drama or stage performances, the smoke effect is sometimes needed. The smoke effect cannot be replaced by vapor of carbon dioxide or smoke produced when something is burning. Therefore, a smoke generator is provided. A smoke oil is guided into a tube to flow, and an electric heating bar heats the smoke oil in the tube to make the smoke oil vaporized into a smoke which is discharged to outside. This type of smoke generator is provided in TWM451175 and TWM492783.

However, in the above-mentioned smoke generator, the smoke naturally diffuses along the tube toward outside; in other words, the smoke is discharged out of the tube slowly (not quickly). In addition, the smoke oil is converted from liquid to gas in the tube which is thin, so the smoke oil in the tube cannot be converted into gas ideally. Thus, a user is unable to get the smoke needed, and if the smoke oil which is not vaporized thoroughly is discharged out, the smoke oil may cause pollution or fire.

The present invention has arisen to mitigate and/or obviate the afore-described disadvantages.

SUMMARY OF THE INVENTION

The major object of the present invention is to provide a smoke generator, which can quickly discharge smoke to outside for a user to use so as to make sure a smoke oil inside has sufficient space to conduct vaporization and further to protect the health of the user and the environment.

To achieve the above and other objects, a smoke generator is provided, including a smoke generating unit and an airflow system. The airflow system has an air inlet passage, an air outlet passage and a vacuum generator, the vacuum generator communicates with the air inlet passage and the air outlet passage, and the vacuum generator has a suction portion communicating with the smoke generating unit.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Please refer to FIGS. 1 to 5 for a preferred embodiment of the present invention. A smoke generator 1 includes a smoke generating unit 2 and an airflow system 3.

Figure 5:
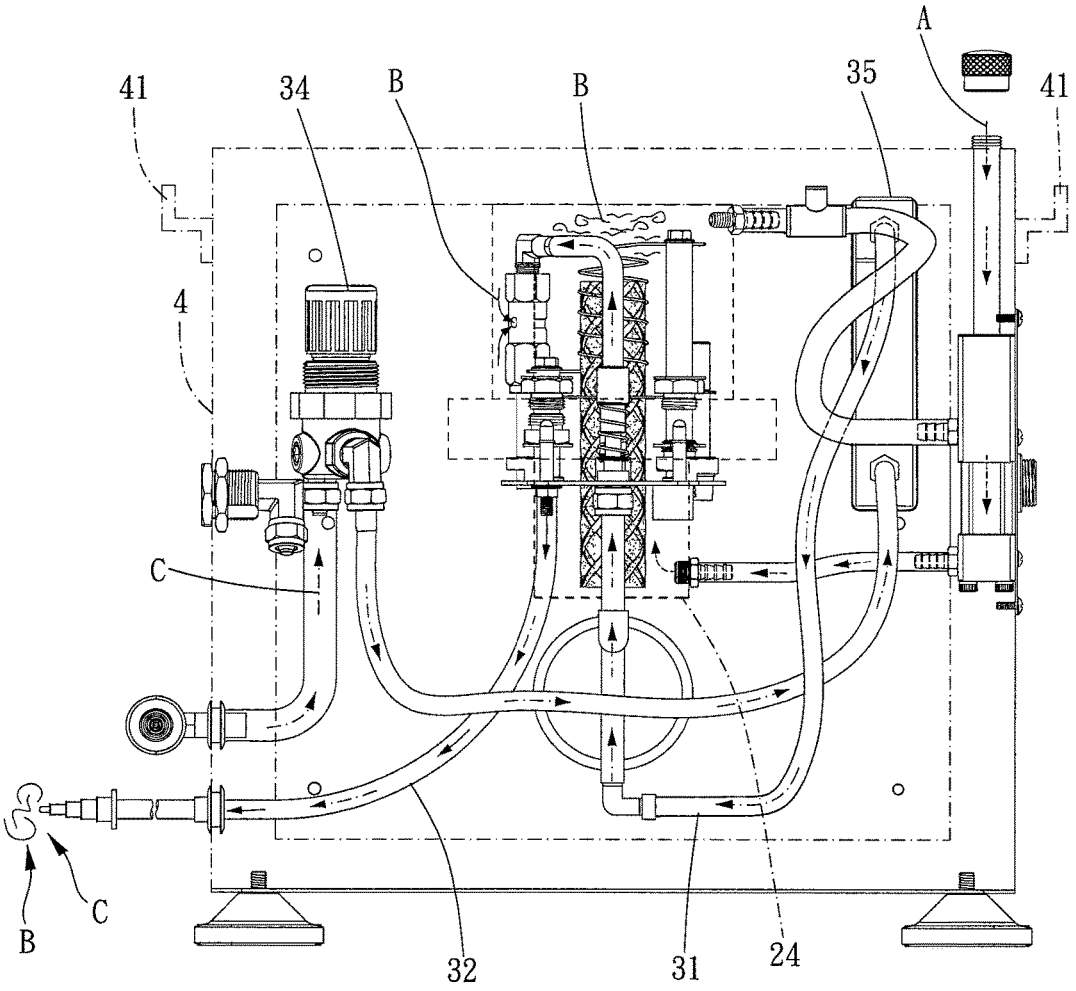
FIG. 5 is a drawing showing a flowing path of the preferred embodiment of the present invention.

The smoke generating unit 2 is provided for converting a smoke oil A into a smoke B. The airflow system 3 has an air inlet passage 31, an air outlet passage 32 and a vacuum generator 33, the vacuum generator 33 communicates with the air inlet passage 31 and the air outlet passage 32, and the vacuum generator 33 has a suction portion 331 communicating with the smoke generating unit 2. The air inlet passage 31 is for guiding an gas C into the vacuum generator 33, and the air outlet passage 32 is for guiding the gas C which has flowed through the vacuum generator 33 to be discharged to outside. During a flowing process of the gas C, the suction portion 331 produces a negative pressure suction force to inhale the smoke B into the vacuum generator 33, and then the smoke B and the gas C are discharged to outside together (as shown in FIG. 5). In other words, the smoke B is quickly discharged to outside through the suction portion 33 sucking the smoke B so as to make sure that the smoke generating unit 2 can have a preferable space for vaporization to convert the smoke oil A into the smoke B continuously.

Specifically, the smoke generating unit 2 includes a smoke room 21, a heating assembly 22, an oil wick 23 and an oil storage tank 24, the oil wick 23 has an oil absorption portion 231 and a heated portion 232, the oil absorption portion 231 extends into the oil storage tank 24 to absorb the smoke oil A by capillary action so that the oil wick 23 is full of the smoke oil A, and at the same time, the heating assembly 22 continues to heat the heated portion 232 so as to convert the smoke oil A into the smoke B. In addition, the smoke room 21 communicates with the heated portion 232 to receive the smoke B, and it is understandable that the suction portion 331 communicates with the smoke room 21. The above-mentioned design can make sure that the smoke oil A which has not been vaporized stays in the oil storage tank 24 stably or is absorbed by the oil wick 23; and the above-mentioned design can further make sure that the vacuum generator 33 only inhales the smoke B but not the smoke oil A so that the smoke oil A can be effectively prevented from being jetted to outside to cause pollution or fire.

Figure 1:
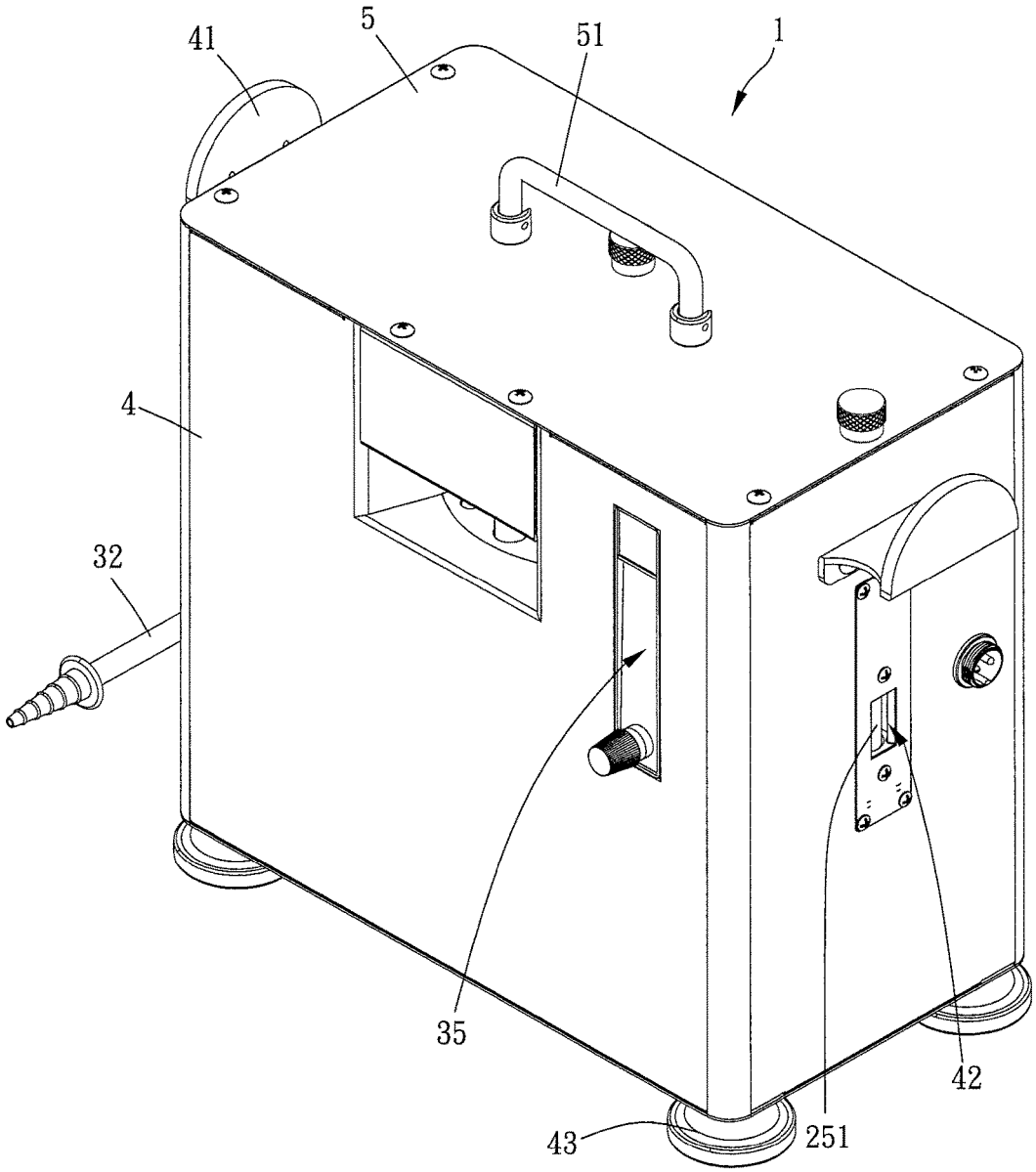
FIG. 1 is a stereogram of a preferred embodiment of the present invention.
Figure 2:
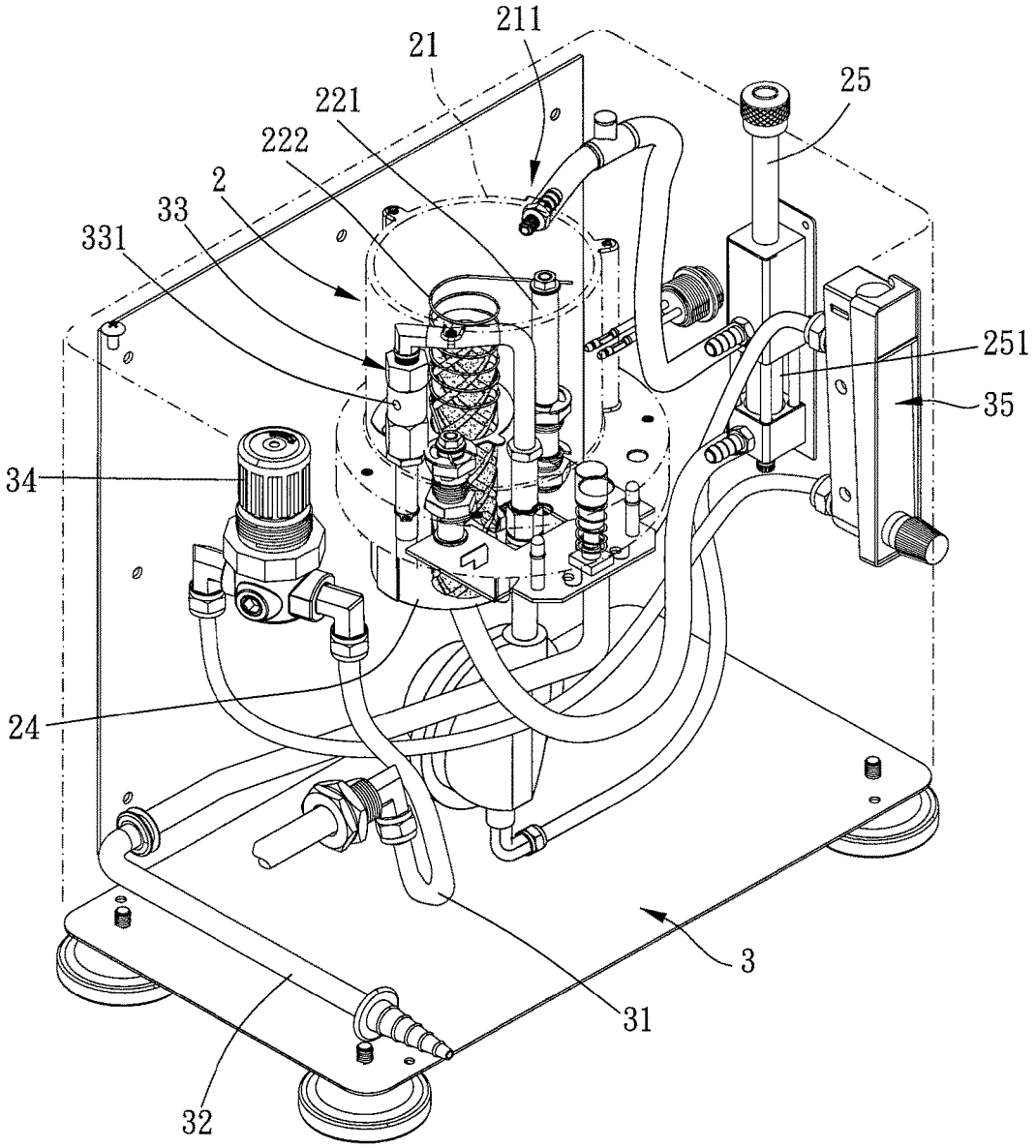
FIG. 2 is a perspective view of FIG. 1.
Figure 3:
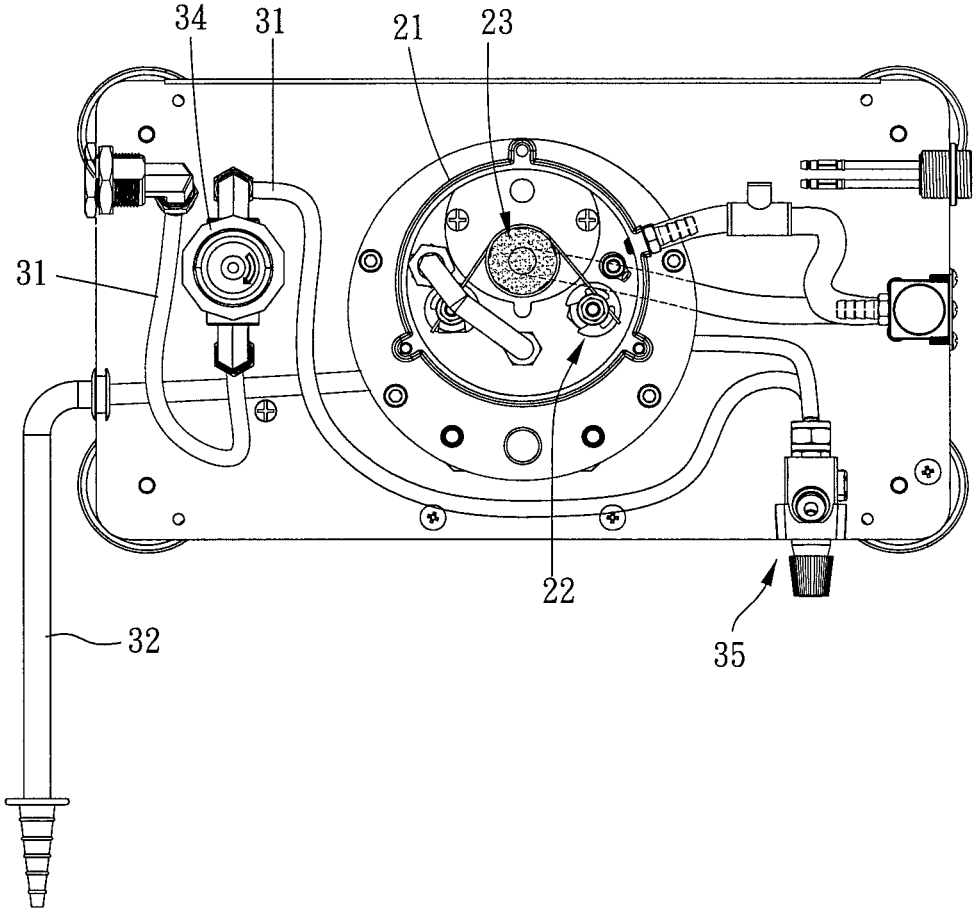
FIG. 3 is a top view of FIG. 1.
Figure 4:
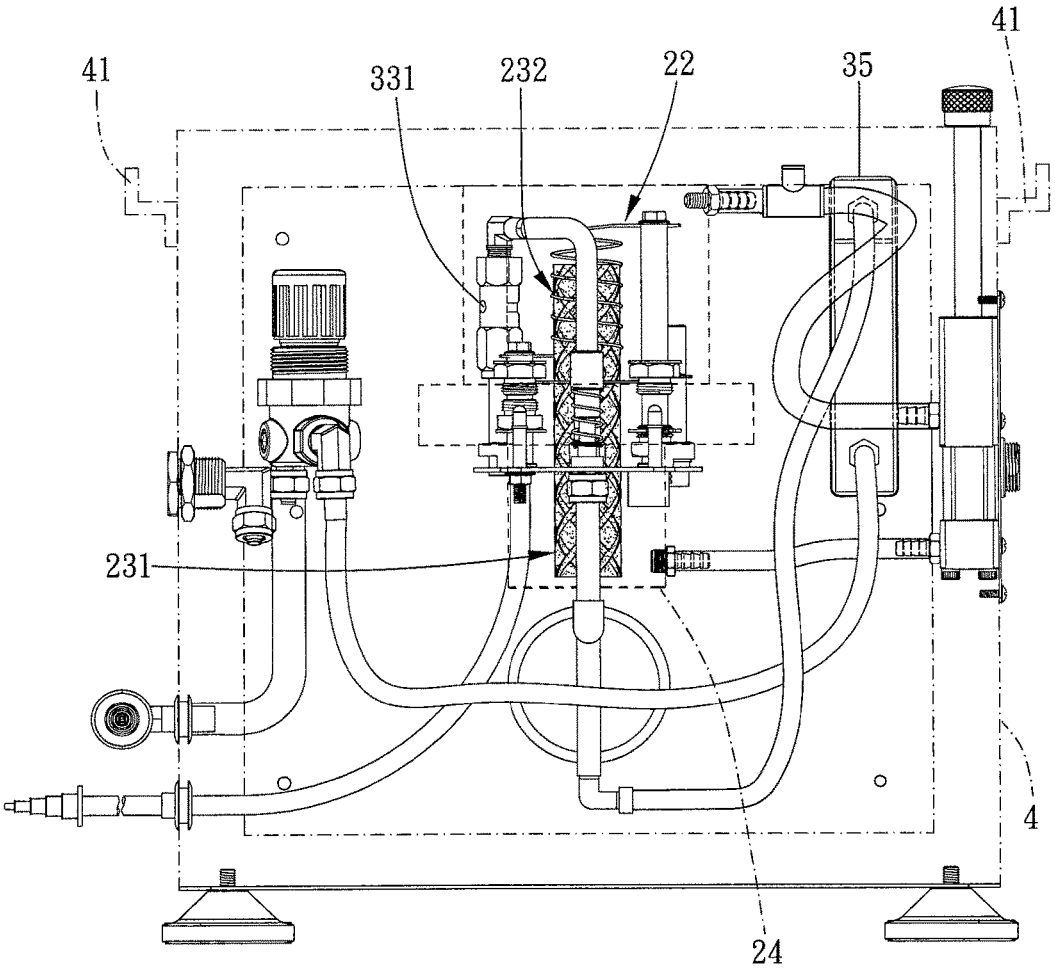
FIG. 4 is another top view of FIG. 1.

More specifically, in this embodiment, a part of the oil wick 23 extends into the smoke room 21 to form the heated portion 232, a part of the oil wick 23 extends into the oil storage tank 24 to form the oil absorption portion 231, and the heating assembly 22 and the vacuum generator 33 are received in the smoke room 21 so that as soon as the smoke B is produced, the smoke B will be inhaled by the vacuum generator 33. Furthermore, the heating assembly 22 includes an electric heater 221 and a heat conduction member 222 which is disposed around an exterior side of the heated portion 232, the heat conduction member 222 is connected to the electric heater 221, and through the heat conduction member 222, the heated portion 232 can be heated evenly to convert the smoke oil A into the smoke B smoothly. It is understandable that the air inlet passage 31 and the air outlet passage 32 are disposed into the smoke room 21 and communicate with the vacuum generator 33 (as shown in FIG. 3). In addition, the smoke room 21 has an air inlet portion 211 for air to enter therethrough, and when the suction portion 331 inhales the smoke B, an airflow is produced to assist the smoke B to be inhaled into the vacuum generator 33 continuously.

Preferably, the smoke generating unit 2 further includes an oil supplying portion 25, and the oil supplying portion 25 communicates with the oil storage tank 24. When the smoke oil A is in shortage, a user only needs to pull in the smoke oil A for supplement from the oil supplying portion 25 (as shown in FIG. 5) without disassembling the oil storage tank 24. Preferably, the oil supplying portion 25 communicates with the oil storage tank 24 via a communication tube, and the oil supplying portion 25 has an observation region 251 through which a state inside the oil supplying portion 25 is observable from an outside of the oil supplying portion 25; therefore, through observing a liquid level of the smoke oil A from the observation region 251, the user can quickly and clearly know the quantity of the smoke oil A remaining in the oil storage tank 24.

For more specific description about the gas C, the gas C is usually a high-pressure gas which is pressurized so that the vacuum generator 33 can produce a preferable suction force, but the gas C may be other gas in accordance with various requirements. Preferably, the airflow system 3 further includes a pressure-adjusting valve 34, the pressure-adjusting valve 34 is arranged within the air inlet passage 31 and located in advance of the vacuum generator 33, and the pressure-adjusting valve 34 can adjust a pressure of the gas C to match a safe pressure value for the smoke generator 1 or a pressure which is needed. In addition, the pressure-adjusting valve 34 can stabilize pressure so that the pressure of the gas C entering the vacuum generator 33 can maintain consistent so as to produce the stable negative pressure suction force. Preferably, the airflow system 3 further includes an adjustable throttle 35, the adjustable throttle 35 is arranged within the air inlet passage 31 and located in advance of the vacuum generator 33, and the user can adjust the flow of the smoke B according to different situations. In this embodiment, on an extension path of the air inlet passage 31, the adjustable throttle 35 is located between the pressure-adjusting valve 34 and the vacuum generator 33.

It is to be noted that in this embodiment, the smoke generator 1 further includes a shell body 4, and the smoke generating unit 2 and at least a part of the airflow system 3 are received in the shell body 4 so as to be carried around. Specifically, the smoke room 21, the oil supplying portion 25, the pressure-adjusting valve 34 and the adjustable throttle 35 are fixedly arranged on the shell body 4 so as to prevent collisions with one another and to arrange paths of the air inlet passage 31 and the air outlet passage 32. It is to be noted that the shell body 4 preferably has an oil quantity observing portion 42, and the oil quantity observing portion 42 corresponds to the observation region 251 so that the user can know the quantity of the smoke oil A remaining in the oil storage tank 24 by observing from the oil quantity observing portion 42. Preferably, the air outlet passage 32 is arranged from inside the shell body 4 to outside so that the user can adjust a position that s/he wants to discharge the smoke B.

More specifically, the smoke generator 1 further includes a cover body 5 covering on the shell body 4 to prevent other objects (such as fire) from dropping into the shell body 4 and causing unpredictable danger. Preferably, a handle 51 is disposed on the cover body 5, and two opposite sides of the shell body 4 are respectively provided with a holding portion 41 for being moved by hands quickly. In addition, a side of the shell body 4 opposite to the cover body 5 is provided with a plurality of foot members 43, each said foot member 43 is for contacting a surface, and when each said foot member 43 is made of rubber, the foot member 43 provides a buffering effect when the smoke generator 1 is placed on the surface. Furthermore, when the surface is uneven, the foot members 43 can provide more stable support.

Given the above, the smoke generator sucks the smoke produced by the smoke generating unit via the negative pressure suction force produced by the vacuum generator so that the smoke can be discharged to outside immediately for the user to use. In addition, the smoke generator has a preferable space for vaporization for converting the smoke oil into the smoke. Furthermore, the user can adjust the inlet air pressure and air quantity instantly according to various requirements so as to produce an appropriate amount of smoke and to create the suitable smoke effect.

While we have shown and described various embodiments in accordance with the present invention, it should be clear to those skilled in the art that further embodiments may be made without departing from the scope of the present invention.

What is claimed is:

1. A smoke generator, including:

a smoke generating unit;

an airflow system, having an air inlet passage, an air outlet passage and a vacuum generator, the vacuum generator being in mechanically serial connection with the air inlet passage and the air outlet passage, the vacuum generator having an suction portion communicating with the smoke generating unit;

wherein the smoke generating unit includes a smoke room, a heating assembly, an oil wick and an oil storage tank, the oil wick has an oil absorption portion and a heated portion, the oil absorption portion extends into the oil storage tank, the heating assembly heats the heated portion, the smoke room communicates with the heated portion, and the suction portion communicates with the smoke room; and wherein the heating assembly and the vacuum generator are received in the smoke room, the heating assembly includes an electric heater and a heat conduction member which is disposed around an exterior side of the heated portion, the heat conduction member is connected to the electric heater, and a part of the heat conduction member spirally coils beyond the heated portion.

2. The smoke generator of claim 1, wherein the smoke generating unit further includes an oil supplying portion, and the oil supplying portion communicates with the oil storage tank.

3. The smoke generator of claim 2, wherein the oil supplying portion communicates with the oil storage tank via a communication tube, and the oil supplying portion has an observation region through which a state inside the oil supplying portion is observable from an outside of the oil supplying portion.

4. The smoke generator of claim 1, wherein the smoke room has an air inlet portion for air to enter therethrough.

5. The smoke generator of claim 1, wherein a part of the oil wick extends into the smoke room to form the heated portion, a part of the oil wick extends into the oil storage tank to form the oil absorption portion, and the air inlet passage and the air outlet passage are disposed into the smoke room and communicate with the vacuum generator.

6. The smoke generator of claim 1, wherein the airflow system further includes a pressure-adjusting valve, and the pressure-adjusting valve is arranged within the air inlet passage and located in advance of the vacuum generator.

7. The smoke generator of claim 1, wherein the airflow system further includes an adjustable throttle, and the adjustable throttle is arranged within the air inlet passage and located in advance of the vacuum generator.

8. The smoke generator of claim 1, further including a shell body, the smoke generating unit and at least a part of the airflow system being received in the shell body.

9. The smoke generator of claim 8, wherein the smoke generating unit further includes an oil supplying portion, and the oil supplying portion communicates with the oil storage tank; the oil supplying portion communicates with the oil storage tank via a communication tube, and the oil supplying portion has an observation region through which a state inside the oil supplying portion is observable from an outside of the oil supplying portion; the smoke room has an air inlet portion for air to enter therethrough; a part of the oil wick extends into the oil storage tank to form the oil absorption portion, and the air inlet passage and the air outlet passage are disposed into the smoke room and communicate with the vacuum generator; the airflow system further includes a pressure-adjusting valve, and the pressure-adjusting valve is arranged within the air inlet passage and located in advance of the vacuum generator; the airflow system further includes an adjustable throttle, and the adjustable throttle is arranged within the air inlet passage and located in advance of the vacuum generator; on an extension path of the air inlet passage, the adjustable throttle is located between the pressure-adjusting valve and the vacuum generator; the smoke generator further includes a cover body covering on the shell body, a handle is disposed on the cover body, and two opposite sides of the shell body are respectively provided with a holding portion; the air outlet passage is disposed from inside of the shell body to outside; the smoke room, the oil supplying portion, the pressure-adjusting valve and the adjustable throttle are fixedly arranged on the shell body, the shell body has an oil quantity observing portion, and the oil quantity observing portion corresponds to the observation region; and a side of the shell body opposite to the cover body is provided with a plurality of foot members, and each said foot member is for contacting a surface.

* * * * *